US010974737B2

(12) United States Patent
Grip

(10) Patent No.: US 10,974,737 B2
(45) **Date of Patent: *Apr. 13, 2021**

(54) SUPPORT SYSTEMS AND METHODS FOR A TRANSPORTATION SYSTEM

(71) Applicant: THE BOEING COMPANY, Chicago, IL (US)

(72) Inventor: Robert Erik Grip, Rancho Palos Verdes, CA (US)

(73) Assignee: THE BOEING COMPANY, Chicago, IL (US)

( * ) Notice: Subject to any disclaimer, the term of this patent is extended or adjusted under 35 U.S.C. 154(b) by 211 days.

This patent is subject to a terminal disclaimer.

(21) Appl. No.: 16/203,715

(22) Filed: Nov. 29, 2018

(65) Prior Publication Data

US 2019/0092352 A1 Mar. 28, 2019

Related U.S. Application Data

(63) Continuation of application No. 15/413,483, filed on Jan. 24, 2017, now Pat. No. 10,189,484.

(51) Int. Cl.

| | |
|---|---|
| ***B61B 13/10*** | (2006.01) |
| ***B61B 13/08*** | (2006.01) |
| ***E01D 11/00*** | (2006.01) |
| ***B61B 5/00*** | (2006.01) |

(52) U.S. Cl.

CPC ..... *B61B 13/10* (2013.01); *B61B 5/00* (2013.01); *B61B 13/08* (2013.01); *E01D 11/00* (2013.01)

(58) Field of Classification Search

CPC ..... B61B 13/10; B61B 5/00; B61B 13/122; B61B 13/08

See application file for complete search history.

(56) References Cited

U.S. PATENT DOCUMENTS

| | | | | |
|---|---|---|---|---|
| 2,088,430 | A * | 7/1937 | Nelles | E01B 25/18 104/123 |
| 3,471,881 | A * | 10/1969 | Kawada | E01D 11/02 14/18 |
| 3,776,141 | A * | 12/1973 | Gelhard | E01B 25/00 104/123 |
| 8,006,625 | B2 * | 8/2011 | Yang | B61B 13/10 104/138.1 |
| 9,290,187 | B2 * | 3/2016 | Dalrymple | B61B 13/122 |
| 10,189,484 | B2 * | 1/2019 | Grip | B61B 5/00 |
| 2002/0104175 | A1 * | 8/2002 | Zivanovic | E01D 19/16 14/22 |

* cited by examiner

*Primary Examiner* — Mark T Le

(74) *Attorney, Agent, or Firm* — The Small Patent Law Group LLC; Joseph Butscher

(57) ABSTRACT

A transportation system includes a first support tower, a second support tower, a suspension cable extending between the first and second support towers, and a tube defining an interior channel extending between the first and second support towers. A vehicle is configured to travel through the interior channel. A tension support member has a first end coupled to the suspension cable and a second end coupled to the first tube through an actuator. The tension support member exerts tension force to upwardly pull the first tube towards the suspension cable. The actuator adjusts the tension force when the vehicle travels through the interior channel under the tension support member to reduce deflection of the tube.

26 Claims, 7 Drawing Sheets

SUPPORT SYSTEMS AND METHODS FOR A TRANSPORTATION SYSTEM

RELATED APPLICATIONS

This application is a continuation of U.S. patent application Ser. No. 15/413,483, entitled "Support Systems and Methods for a Transportation System," filed Jan. 24, 2017, now U.S. Pat. No. 10,189,484, which is hereby incorporated by reference in its entirety.

FIELD OF EMBODIMENTS OF THE DISCLOSURE

Embodiments of the present disclosure generally relate to transportation systems, and, more particularly, to systems and methods of supporting vehicles that travel through tubes supported above a surface of the ground.

BACKGROUND OF THE DISCLOSURE

Magnetic levitation is a form of transportation in which a vehicle is moved via magnetic levitation without contacting the ground. As such, the vehicle is able to move without experiencing rolling friction with the ground or support rails, for example. In general, the vehicle travels along a guideway via magnets that generate lift and propulsion, thereby reducing friction and allowing travel at high speeds.

Currently, magnetic levitation systems are being developed in which a vehicle travels through vacuum tubes, in order to reduce the effects of aerodynamic drag on the vehicle. As such, the speed and operational efficiency of the vehicle are increased through the elimination or reduction of air friction with respect to the vehicle. The magnetic levitation system reduces static and rolling friction with respect to the vehicle, while the vacuum tube reduces air friction. A reduced friction vehicle system, such as a magnetic levitation vehicle that travels through a vacuum tube, may be positioned underneath a ground surface, and/or may be supported over the ground surface.

The tube may vertically deflect as the vehicle travels therethrough. The deflections of the tube under vertical load applied by the vehicle traveling therein may be unsettling to passengers. For example, a magnetic levitation vehicle system may include vacuum tubes constructed of steel. For a tube sized such that one atmosphere (atm) of pressure creates a stress equal to an allowable stress divided by a safety factor, the deflections for a tube with supports spaced 300 feet apart is approximately 0.095 inches. Such a magnitude of deflection may cause discomfort to passengers aboard the vehicle traveling through the tube.

In order to reduce tube deflections, a tube of increased strength and robustness may be used so that the bending moment of inertia is increased. If the diameters of the tubes are held constant, the amount of weight is inversely proportional to the deflections. Thus, in order to achieve reduced deflections to 0.045 inches, for example, the tube would need to be twice the weight. As can be appreciated, tubes of increased size and weight increase the overall cost of the transportation system.

As another option, the spacing between support columns that support the tube above the ground may be reduced. Notably, tube deflections are proportional to the spacing between support columns. As an example, by moving support columns closer by sixteen percent (to 252 feet instead of 300 feet), deflections may be reduced to 0.045 inches. Again, however, reducing the spacing between support columns requires an increased number of support columns, which increases the overall cost of the transportation system.

Alternatively, the support columns may be eliminated by locating the tubes below the ground surface through tunneling. However, the process of tunneling substantially increases the cost of the transportation system. Overall, tunnels are more expensive than above ground systems. Additionally, pressures exerted into the tubes that are below ground are typically greater than one atmosphere, which is the pressure exerted into an above ground tube. As such, the increased pressure may require stronger (and expensive) tubes to be used.

SUMMARY OF THE DISCLOSURE

A need exists for a system and method for supporting an above ground tube that reduces deflections as a vehicle travels through the tube. A need exists for a system and method for efficiently and cost-effectively reducing tube deflections of an above ground tube-based transportation system.

With those needs in mind, certain embodiments of the present disclosure provide a transportation system that includes a first support tower, a second support tower, a suspension cable extending between the first and second support towers, and a first tube defining a first interior channel extending between the first and second support towers. A vehicle is configured to travel through the first interior channel. A tension support member has a first end coupled to the suspension cable and a second end coupled to the first tube through an actuator. The tension support member exerts tension force to urge (such as upwardly pull) the first tube towards the suspension cable. The actuator adjusts the tension force when the vehicle travels through the first interior channel under the tension support member to reduce deflection of the first tube.

In at least one embodiment, the actuator is configured to contract to adjust the tension force. In at least one other embodiment, the actuator is configured to adjust a length of the tension support member to adjust the tension force.

In at least one embodiment, the actuator includes a bearing, and an actuating member moveably secured to the bearing. The actuator is configured to move with respect to the bearing in order to adjust the tension force. The bearing may be directly coupled to one of the suspension cable or the first tube, while the actuator is directly coupled to the other of the suspension cable or the first tube.

The transportation system may also include a tension control unit in communication with the actuator. The tension control unit is configured to control operation of the actuator to adjust the tension force.

A plurality of sensors may be coupled to the first tube. The sensors are configured to detect a location of the vehicle within the first interior channel. The tension control unit is in communication with the plurality of sensors.

The transportation system may include a second tube coupled to the first tube (such as to allow for transportation in different directions along the same route). The second tube defines a second interior channel extending between the first and second support towers. The vehicle is configured to travel through the second interior channel. The first tube may be stacked over the second tube. Optionally, the first tube is arranged to a side of the second tube.

A vacuum may be formed in the first and/or second interior channels. The vacuum eliminates, minimizes, or otherwise reduces aerodynamic drag on the vehicle as the vehicle travels through the interior channels. In at least one embodiment, the vehicle is a magnetic levitation vehicle.

The first and/or second tubes may include an outer tube surrounding an inner tube. The outer tube may be separated from the inner tube by a space. A plurality of stiffeners may be disposed within the space between the outer tube and the inner tube. The stiffeners may define a plurality of sealed compartments. At least one fluid sensor may be within at least one of the plurality of sealed compartments.

The space may be divided into a plurality of vacuum sections. Each of the vacuum sections includes a different degree of vacuum. The different degrees of vacuum within the plurality of vacuum sections are configured to set a vacuum within the interior channel to a desired level.

Certain embodiments of the present disclosure provide a method of supporting a transportation system. The method includes supporting a suspension cable between a first support tower and a second support tower, positioning a tube defining an interior channel between the first and second support towers (wherein a vehicle is configured to travel through the interior channel), coupling a first end of a tension support member to the suspension cable, coupling a second end of the tension support member to the tube through an actuator, exerting tension force with the tension support member to upwardly pull the tube towards the suspension cable, and adjusting the tension force via the actuator when the vehicle travels through the interior channel under the tension support member to reduce deflection of the tube.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide a transportation system that includes a tube longitudinally supported by a plurality of support towers. A suspension cable extends between the support towers. A plurality of tension support members connect the tube to the suspension cable. Each tension support member connects to the tube via an actuator. As a vehicle passes through the tube, the actuator reacts to offset deflection in the tube that would otherwise be caused by the vehicle passing therethrough.

In at least one embodiment, the tube includes a double-walled construction. For example, the tube includes an inner tube surrounded by an outer tube. One or more stiffeners may be used between the inner and outer tubes. One or more sensors may be secured between the inner and outer tubes. The sensors may be used to monitor the pressure and structural integrity of the tube.

Figure 1:
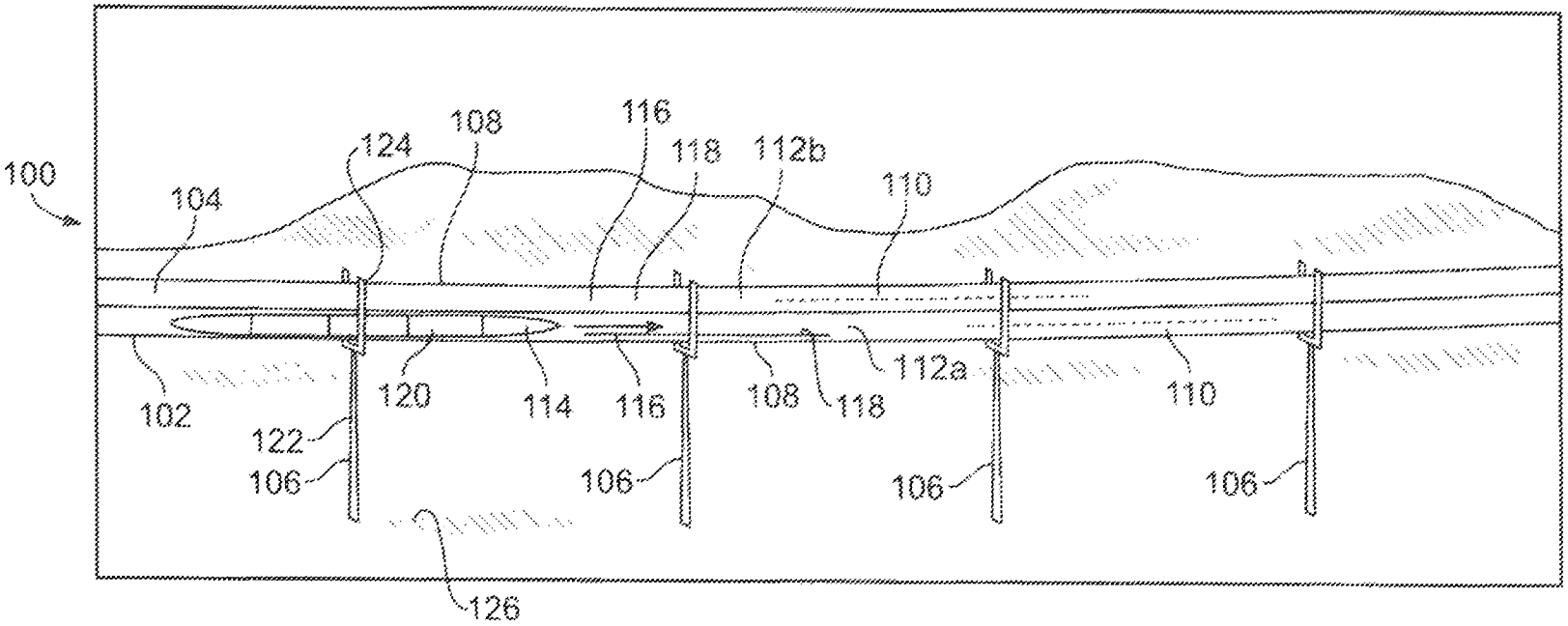
FIG. 1 illustrates a lateral view of a transportation system, according to an embodiment of the present disclosure.

FIG. 1 illustrates a lateral view of a transportation system 100, according to an embodiment of the present disclosure. The transportation system 100 includes tubes 102 (for example, a first tube) and 104 (for example, a second tube) supported above ground by a plurality of support columns 106. As shown, the tube 104 is secured directly over the tube 102. Alternatively, the tubes 102 and 104 may be secured together in a side-by-side relationship. Optionally, the transportation system 100 may include more or less tubes than shown. For example, the transportation system 100 may include only the tube 102 or the tube 104.

Each tube 102 and 104 includes an outer circumferential wall 108 that extends longitudinally along a longitudinal axis 110. The wall 108 defines a hollow interior channel 112 (such as interior channel 112*a* and interior channel 112*b*) that is configured to allow a vehicle 114 to pass therethrough. In at least one embodiment, the interior channel 112 is a vacuum channel, which eliminates or otherwise reduces aerodynamic drag on the vehicle 114.

Guideways 116 may be secured within each interior channel 112. The guideways 116 are configured to support the vehicle 114, which is conveyed along the guideways 116. In at least one embodiment, the guideways 116 include guideway magnetic levitation components 118, such as electromagnets, that cooperate with vehicle magnetic levitation components 120 of the vehicle 114 to convey the vehicle 114 through the tubes 102 and 104. Alternatively, the guideways 116 may not be configured for magnetic levitation transportation. Instead, the guideways 116 may be rails, tracks, and/or surfaces that are configured to support components, such as wheels, of the vehicle 114.

Each support column 106 includes a weight-bearing main member 122, such as a post, column, bracket, and/or the like, that connects to a tube coupler 124, such as a cradle, clamping bracket, prongs, scaffolds, and/or the like. The support columns 106 are configured to support the weight of the vehicle 114 and the tubes 102 and 104. In this manner, the support columns 106 may be formed of concrete, steel, and/or the like, and extend underneath the ground 126. The support columns 106 are bulky and stiff so that they may support compressive forces exerted therein by the vehicle 114 and the tubes 102 and 104.

Figure 2:
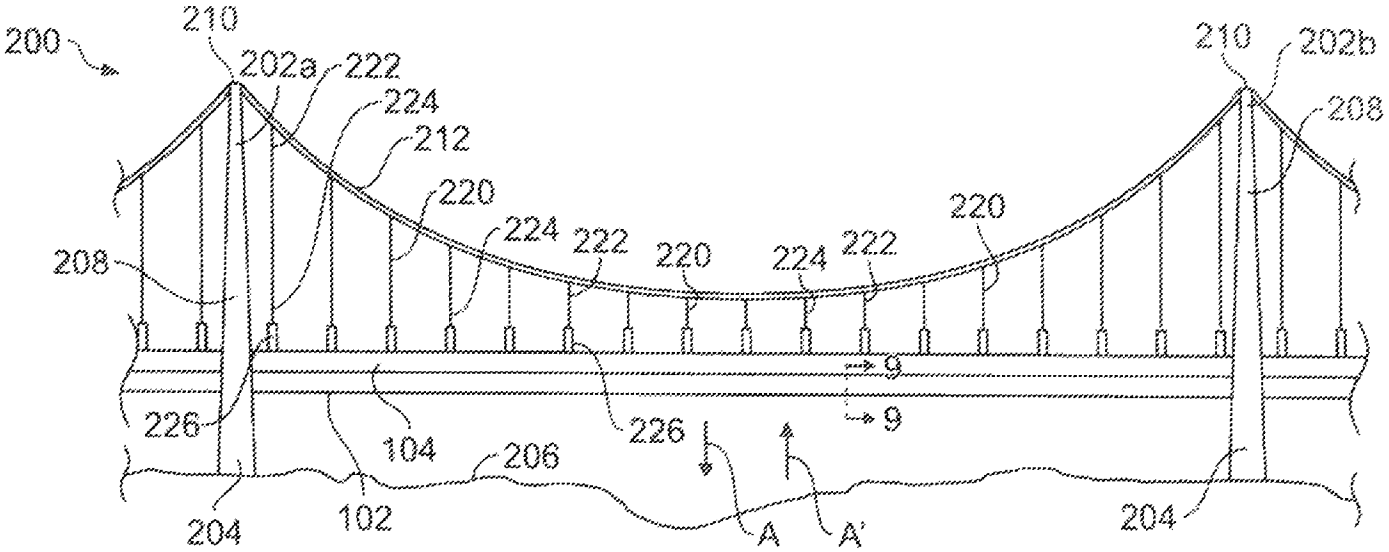
FIG. 2 illustrates a lateral view of a transportation system, according to an embodiment of the present disclosure.

FIG. 2 illustrates a lateral view of a transportation system 200, according to an embodiment of the present disclosure. The transportation system 200 includes the tubes 102 and 104 supported above ground by a plurality of support columns, such as support towers 202 (for example, a first support tower 202*a* and a second support tower 202*b*). Each support tower 202 includes a base 204 securely anchored into the ground 206. The base 204 is integrally connected to an extension column 208 having a upper end 210. A suspension cable 212 couples to the upper end 210 of each support tower 202, such as through anchors, couplings, fasteners, and/or the like. The suspension cable 212 spans between two spaced-apart support towers 202. As shown, the suspension cable 212 may downwardly bow or sag between the support towers 202. The degree of bowing or other such curvature of the suspension cable 212 may be greater or less than shown. Optionally, the suspension cable 212 may not downwardly bow between the support towers 202.

A plurality of tension support members 220 connect the tubes 102 and 104 to the suspension cable 212 between the support towers 202. Each tension support member 220 may be or otherwise include one or more cables, wires, ropes, and/or the like, which may not be configured to carry compression loads. In at least one other embodiment, the tension support member 220 may be I-beam, T-beam, Z-beams, and/or tubular members. Each tension support member 220 is substantially lighter and smaller than the support towers 202. The length of each tension support member 220 may vary depending on where they connect to the suspension cable 212. For example, tension support members 220 proximate to the support towers 202 may be longer than tension support members 220 distally located from the support towers 202, such as at a midpoint between the support towers 202.

An upper end 222 of each tension support member 220 connects to the suspension cable 212, such as through couplings, fasteners, adhesives, joints, and/or the like. A lower end 224 of each tension support member 220 connects to the tube(s) 102 and/or 104 through an actuator 226. As a vehicle (such as the vehicle 114 shown in FIG. 1) travels through the tubes 102 or 104, the weight of the vehicle 114 tends to downwardly deflect the tubes 102 and 104 in the direction of arrow A. The actuators 226 react to the motion of the vehicle through the tubes 102 and 104 below the tension support members 220 to offset the deflection. For example, the actuators 226 react to the force exerted into the tubes 102 and 104 by the moving vehicle 114 by exerting an equal and opposite force in the direction of arrow A' into the tension support members 202 above the tubes 102 or 104 through which the vehicle is moving, thereby offsetting deflections that would otherwise be generated in the tubes 102 and 104. In this manner, the actuators 226 resist deflections and ensure that the tubes 102 and 104 remain substantially straight between the support towers 202 as vehicles pass through the tubes 102 and 104.

Figure 3:
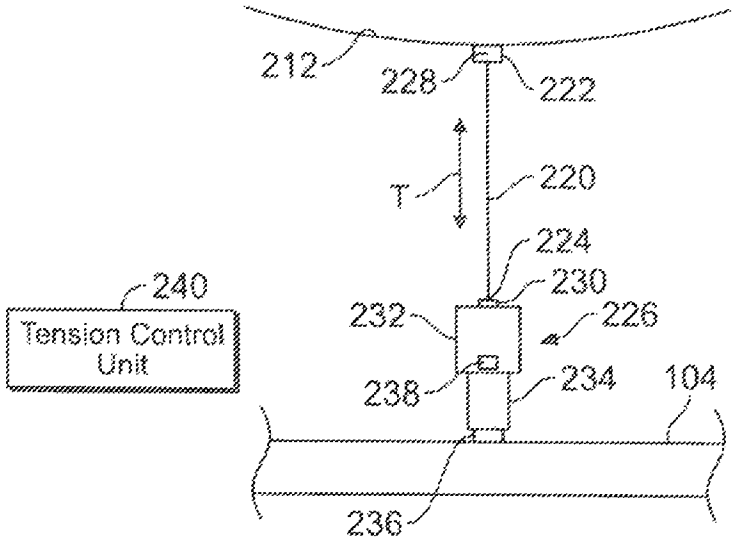
FIG. 3 illustrates a lateral view of a tension support member connected between a suspension cable and a tube, according to an embodiment to the present disclosure.

FIG. 3 illustrates a lateral view of a tension support member 220 connected between the suspension cable 212 and the tube 104, according to an embodiment to the present disclosure. For the sake of clarity, the tube 102 (shown in FIGS. 1 and 2) is not shown in FIG. 3. It is to be understood that the tension support member 220 may connect to both the tubes 102 and 104, or just one of the tubes 102 and 104.

The upper end 222 of the tension support member 220 connects to the suspension cable 212 through a coupling 228, such as a connection bracket, collar, ring, bearing, winding, fastener(s), and/or the like. The lower end 224 of the tension support member 220 connects to the actuator 226, such as through a coupling 230, such as a connection bracket, collar, ring, bearing, winding, fastener(s), and/or the like.

The actuator 226 includes a bearing 232 (such as a hollow cylinder) that movably retains an actuating member 234, such as a piston, drive, or the like that is moveably coupled to the bearing 232. A lower end of the actuating member 234 is coupled to the tube 104, such as through a coupling 236, such as a connection bracket, joint, collar, ring, bearing, fastener(s), and/or the like. Optionally, the bearing 232 may be directly coupled to the tube 104, while the actuating member 234 directly couples to the lower end 224 of the tension support member 220. The actuator 226 may further include a motive device 238, such as an electric, hydraulic, pneumatic, or the like motor, actuating link, gears, worm-screw(s), and/or the like that is configured to move the actuating member 234 relative to the bearing 232. The actuator 226 may be a hydraulic actuator, for example. In at least one other embodiment, the actuator 226 may be an electric, electromechanical, pneumatic, or other such actuator.

In at least one embodiment, each actuator 226 is in communication with a tension control unit 240, such as through one or more wired or wireless connections. For example, the tension control unit 240 may be in communication with the motive device 238 of each actuator 226. In at least one embodiment, the tension control unit 240 is configured to operate each actuator 226 to offset deflections in the tube 104 as a vehicle passes therethrough.

A tension force T is exerted into the tension support member 220 between the suspension cable 212 and the tube 104. The tension force T pulls the suspension cable 212 down toward the tube 104, while simultaneously pulling the tube 104 upwardly toward the suspension cable 212. As such, the tension support member 220 supports the tube 104 in position by pulling upwardly on the tube 104.

Figure 4:
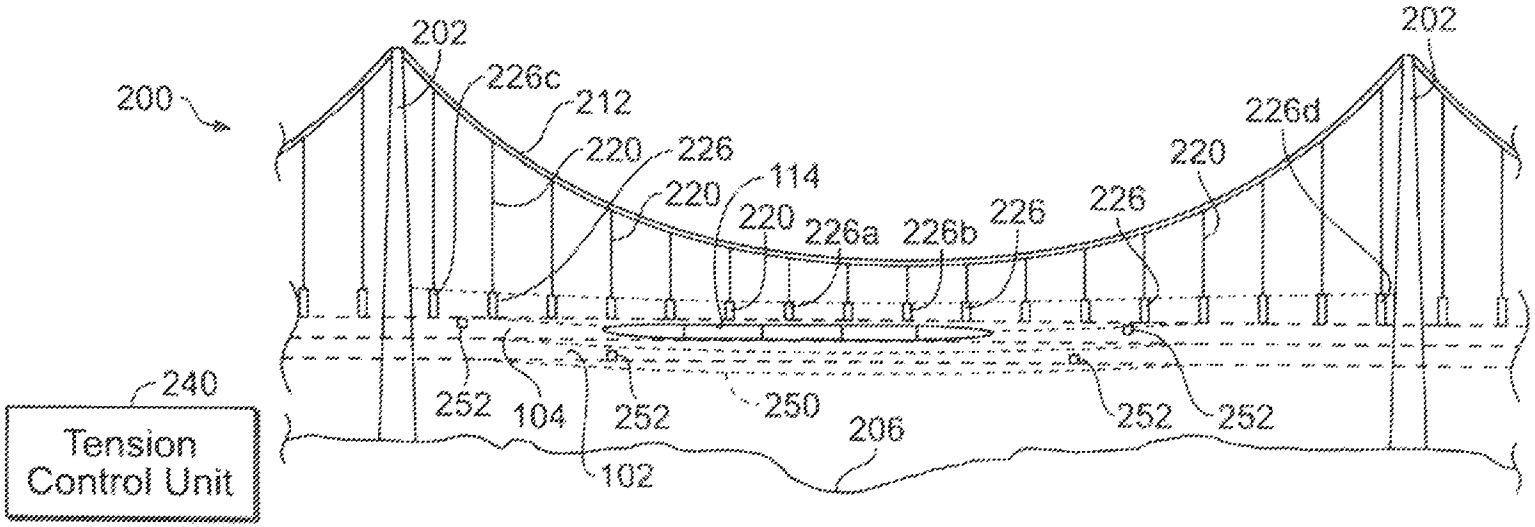
FIG. 4 illustrates a lateral view of a vehicle traveling through a tube of a transportation system, according to an embodiment of the present disclosure.

FIG. 4 illustrates a lateral view of the vehicle 114 traveling through the tube 104 of the transportation system 200, according to an embodiment of the present disclosure. The tension control unit 240 is in communication with each of the actuators 226 through one or more wired or wireless connections. Optionally, a plurality of separate and distinct tension control units may be with a respective plurality of actuators 226.

A plurality of sensors 252 may be positioned on or within the tubes 102 and 104. The sensors 252 may be weight sensors (for example, electronic scales), inertial sensors, motion sensors, and/or the like that are in communication with the tension control unit 240 through one or more wired or wireless connections. The sensors 252 output signals to the tension control unit 240 that allow the tension control unit 240 to determine the position of the vehicle 114 within the tubes 102 and 104. Optionally, the tension control unit 240 may be in communication with a global positioning system (GPS) onboard the vehicle 114 to determine a position of the vehicle 114 within the tubes 102 and 104. Based on the known position, weight, and/or speed of the vehicle 114 within the tubes 102 and 104, the tension control unit 240 operates the actuators 226 to offset deflections that would otherwise be caused by the moving vehicle 114 in order to ensure that the tubes 102 and 104 do not undesirably deflect between the support towers 202.

For example, as the vehicle 114 travels through the tube 104 (or 102), the weight of the vehicle 114 would otherwise tend to deflect the tubes 102 and 104 downwardly as shown by the dashed lines 250. The tension control unit 240 includes a memory that stores the known weight of the vehicle 114. Based on the position of the vehicle 114 within the tube 104, the tension control unit 240 operates the actuators 226 to exert an equal and opposite force into the tubes 102 and 104 as the vehicle 114 travels therethrough.

The tension control unit 240 may control the actuators 226 to change lengths of the actuators 226 (such as through retraction/contraction and extension) to offset deflections that would otherwise be caused by the moving vehicle 114. In at least one other embodiment, the actuators 226 may be configured to change the lengths of the tension support members 220 themselves (such as through stretching, shortening, coiling, winding, and/or the like). In such an embodiment, the length of the actuators 226 may remain the same, while the lengths of the tension support members 220 are varied. In general, as the vehicle 114 passes through the tubes 102 and 104, the actuators 226 are controlled to control the tension force exerted into the tubes 102 and 104 to offset deflection that would otherwise be caused by the vehicle 114 moving through the tubes 102 or 104.

Referring to FIGS. 3 and 4, as the vehicle 114 is within the tube 104 below a particular tension support member 220, the tension control unit 240 operates the motive device 238 to upwardly draw the actuating member 234 into the bearing 232, thereby upwardly pulling the tubes 102 and 104 toward the suspension cable 212. In this manner, the actuators 226 contract in size as the vehicle 114 passes through the tubes 102 and 104 below. As such, the length of the actuators 226 shorten as the vehicle 114 passes through the tubes 102 and 104 below the actuators 226, which pulls the tubes 102 and 104 upwardly toward the suspension cable 212. The tension control unit 240 controls the motion of the actuators 226 to offset the weight of the vehicle 114 passing through the tubes 102 and 104, thereby resisting deflections in the tubes 102 and 104.

As shown in FIG. 4, the lengths of actuators 226*a* and 226*b* are shorter than lengths of the actuators 226*c* and 226*d* because the vehicle 114 is underneath the actuators 226*a* and 226*b*, but not the actuators 226*c* and 226*d*. The tension control unit 240 controls the length of the actuators 226 based on a position of the vehicle 114 within the tubes 102 and 104 to offset deflections in the tubes 102 and 104 that would otherwise be caused by the vehicle 114.

As shown, the transportation system 200 provides a suspension cable 212 between the support towers 202. The tubes 102 and 104 are coupled to the suspension cable 212 via the tension support members 220. The suspension bridge configuration reduces a number of supports that interface with the ground 206. The tension support members 220 allow the tubes 102 and 104 to be supported at shorter spacings at a substantially lower cost than if standard column supports that couple to the ground 206 were used. In addition, the transportation system 200 allows for the tubes 102 and 104 to span over bodies of water. For example, the tower supports 202 may be located on shore proximate to the body of water or even a distance into the water. In at least one embodiment, at least one of the support towers 202 may be positioned within a body of water (with the ground 206 representing the floor of the body of water).

Control of the actuators 226 to offset deflections in the tubes 102 and 104 may be determined through mathematical models of the transportation system 200. Through knowledge of weight of the vehicle 114, the speed of the vehicle 114 within a tube 102 or 104, and the mass properties of the tubes 102 and 104, the tension control unit 240 is able to determine deflections in the tubes 102 and 104 as the vehicle 114 passes therethrough. Based on such calculated deflections, the tension control unit 240 operates the actuators 226 to exert equal but opposite tension forces into the tubes 102 and 104 to offset the deflections.

In at least one embodiment, the sensors 252 (such as inertial sensors) may be used to assess the position of the tubes 102 and 104. As the tubes 102 and 104 deflect, the tension control unit 240 may operate the actuators 226 to maintain the tubes 102 and 104 at a stable position. The sensors 252 may be also be used to confirm the accuracy of the mathematical model(s).

The number of tension support members 220 may be adjusted to provide redundancy in the event that one of the actuators 226 malfunctions or is actuated incorrectly. For example, if one of the actuators 226 malfunctions, there may be numerous (for example, five or more) actuators 226 to pick up the load and counter-deflect the tubes 102 and 104.

As used herein, the term "controller," "control unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the tension control unit 240 may be or include one or more processors that are configured to control operation of the actuators 226, as described above.

The tension control unit 240 is configured to execute a set of instructions that are stored in one or more data storage units or elements (such as one or more memories), in order to process data. For example, the tension control unit 240 may include or be coupled to one or more memories. The data storage units may also store data or other information as desired or needed. The data storage units may be in the form of an information source or a physical memory element within a processing machine.

The set of instructions may include various commands that instruct the tension control unit 240 as a processing machine to perform specific operations such as the methods and processes of the various examples of the subject matter described herein. The set of instructions may be in the form of a software program. The software may be in various forms such as system software or application software. Further, the software may be in the form of a collection of separate programs, a program subset within a larger program, or a portion of a program. The software may also include modular programming in the form of object-oriented programming. The processing of input data by the processing machine may be in response to user commands, or in response to results of previous processing, or in response to a request made by another processing machine.

The diagrams of examples herein may illustrate one or more control or processing units, such as the tension control unit 240. It is to be understood that the processing or control units may represent circuits, circuitry, or portions thereof that may be implemented as hardware with associated instructions (e.g., software stored on a tangible and nontransitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the tension control unit 240 may represent processing circuitry such as one or more of a field programmable gate array (FPGA), application specific integrated circuit (ASIC), microprocessor(s), and/or the like. The circuits in various examples may be configured to execute one or more algorithms to perform functions described herein. The one or more algorithms may include aspects of examples disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 5:
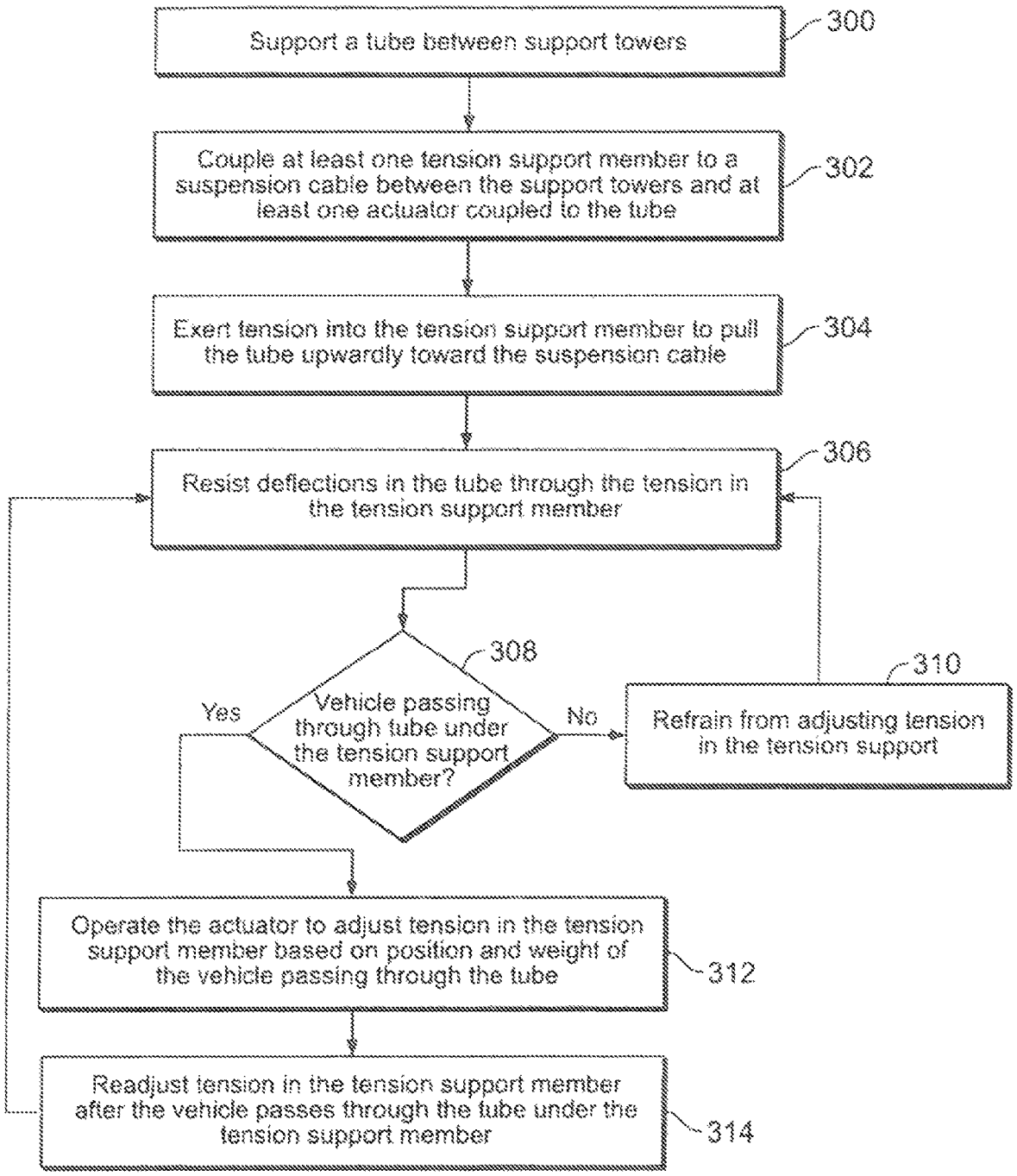
FIG. 5 illustrates a flow chart of a method of supporting one or more tubes of a transportation system, according to an embodiment of the present disclosure.

FIG. 5 illustrates a flow chart of a method of supporting the tubes 102 and 104 of the transportation system 200, according to an embodiment of the present disclosure. Referring to FIGS. 2-5, the method begins at 300, in which the tubes 102 and 104 are supported between the support towers 202. At 302, at least one tension support member 220 is coupled to the suspension cable 212 between the support towers 202 and at least one actuator 226 coupled to the tubes 102 and 104. At 304, tension is exerted into the tension members 220 (such as via the actuators 226) to pull the tubes 102 and 104 upwardly toward the suspension cable 212. Deflections in the tubes 102 and 104 are resisted through the tension in the tension support members 220.

At 308, the tension control unit 240 determines whether the vehicle 114 is passing through a tube 102 or 104 underneath a particular tension support member 220. If not, the method proceeds to 310, at which the tension control unit 240 refrains from adjusting tension in the tension support member 220. The method then returns to 306.

If, however, the tension control unit 240 determines that the vehicle 114 is passing through the tube 102 or 104 underneath the tension support member 220 at 308, the method proceeds to 312, at which the tension control unit 240 operates the actuator 226 to adjust the tension in the tension support member 220 (such as through contracting the length of the actuator 226 itself, and/or shortening the length of the tension support member 220) based on a position and weight of the vehicle 114 passing through the tube 102 or 104. The method then proceeds to 314, at which the tension control unit 240 readjusts tension in the tension support member 220 after the vehicle passes through the tube under the tension support member 220. The method then returns to 306.

Figure 6:
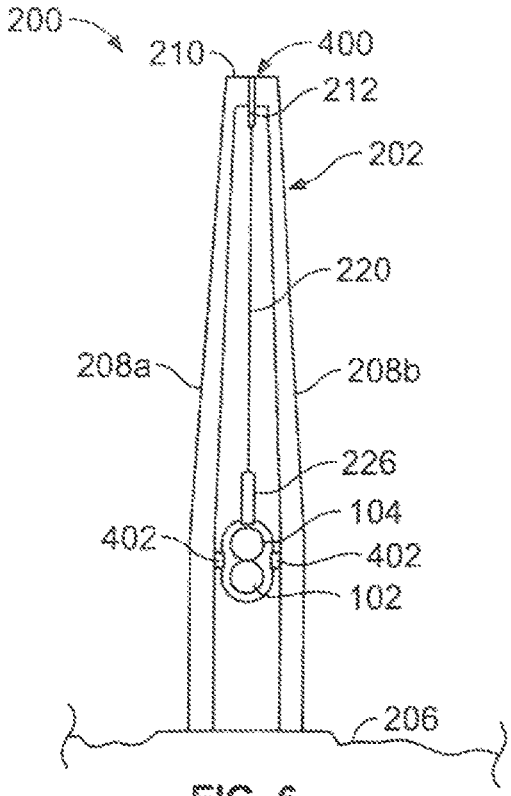
FIG. 6 illustrates an end view of a transportation system, according to an embodiment of the present disclosure.

FIG. 6 illustrates an end view of the transportation system 200, according to an embodiment of the present disclosure. As shown, the support towers 202 may include opposed lateral columns 208*a* and 208*b* that connect at an upper cross beam 400 that provides the upper end 210 to which the suspension cable 212 secures. As shown, the tubes 102 and 104 may be vertically oriented in relation to one another, such that the tube 104 is positioned directly above (for example, stacked over) the tube 102. Lateral stabilizing beams 402 may connect sides of the tubes 102 and 104 to interior portions of the columns 208*a* and 208, in order to laterally stabilize the tubes 102 and 104. For a vacuum tube transportation system supported by a series of regularly-spaced support towers 202, the vertical orientation of the tubes 102 and 104 shown in FIG. 6 provides an efficient structural arrangement because of the greater moment of inertia of the vertically arranged tubes, as compared to smaller stresses and/or deflections from horizontal loading, such as wind.

Figure 7:
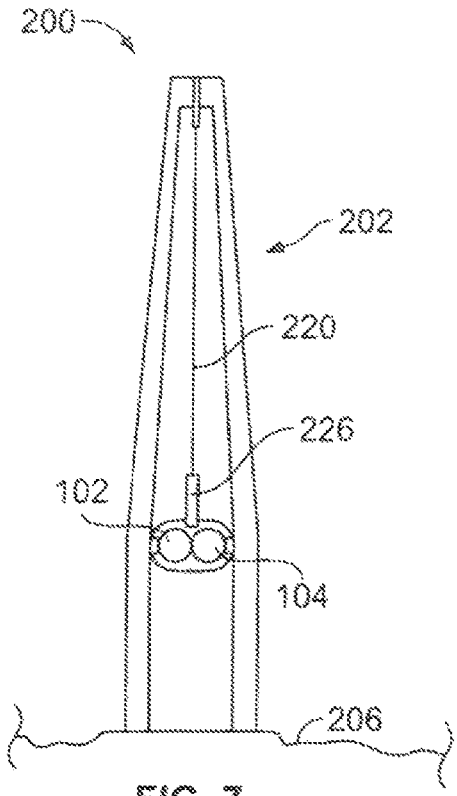
FIG. 7 illustrates an end view of a transportation system, according to an embodiment of the present disclosure.

FIG. 7 illustrates an end view of the transportation system 200, according to an embodiment of the present disclosure. In this embodiment, the tubes 102 and 104 are arranged in a side-by-side fashion. Such an embodiment may be used in areas of high winds, as the lateral orientation of the tubes 102 and 104 is better suited to resist wind forces.

Figure 8:
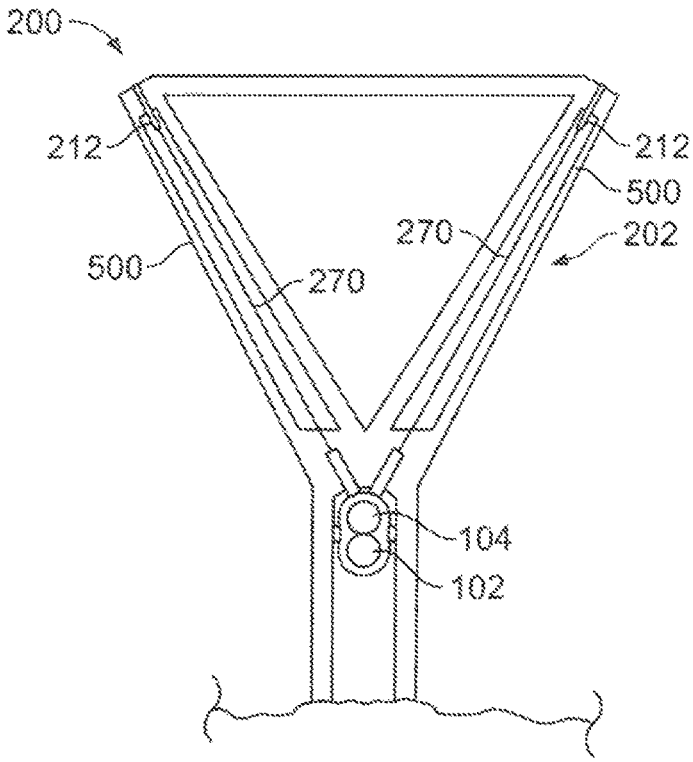
FIG. 8 illustrates an end view of a transportation system, according to an embodiment of the present disclosure.

FIG. 8 illustrates an end view of the transportation system 200, according to an embodiment of the present disclosure. In this embodiment, angled columns 500 may be used to couple angled tension support members 220 to the tubes 102 and 104. As shown, the tubes 102 and 104 may be vertically oriented, and lateral loads are resisted by using two sets of suspension cables 212 attached to the two angled columns 500.

Figure 9:
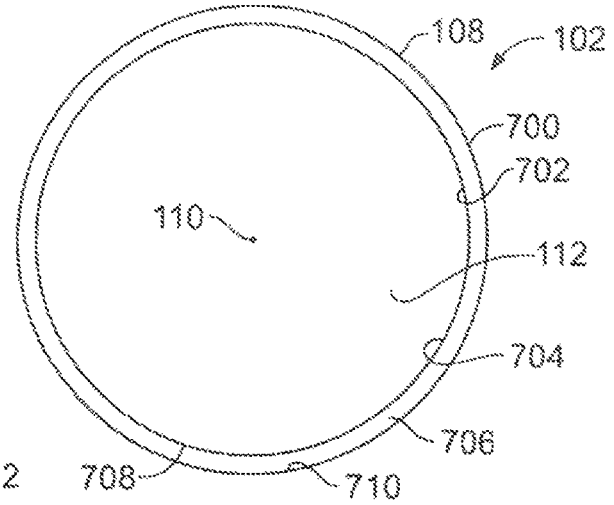
FIG. 9 illustrates an axial cross sectional view of a tube through line 9-9 of FIG. 2, according to an embodiment of the present disclosure.

FIG. 9 illustrates an axial cross sectional view of the tube 102 (or 104) through line 9-9 of FIG. 2, according to an embodiment of the present disclosure. The tube 102 includes an outer circumferential wall 108 that extends longitudinally along and around a longitudinal axis 110. The tube 102 includes the hollow interior channel 112. As indicated, the interior channel 112 may be a vacuum channel. That is, a vacuum may exist within the interior channel 112.

The outer circumferential wall 108 may be formed by an outer tube 700 that surrounds an inner tube 702. The outer tube 700 and the inner tube 702 may be concentric. An interior surface 704 of the inner tube 702 defines the interior channel 112. The outer circumferential wall 108 may overlay the inner tube 702. In at least one embodiment, the outer tube 700 is separated from the inner tube 702 by a space 706, which may be a vacuum space. The outer tube 702 may securely couple to the inner tube 702 through one or more stabilizers (such as fins, beams, ridges, ribs, or the like) disposed between an outer surface 708 of the inner tube 702 and an inner surface 710 of the outer tube 702.

In operation, the outer tube 700 protects the inner tube 702 from being damaged. For example, the outer tube 700 provides a covering shield that protects the inner tube 702 from being perforated, punctured, or otherwise compromised. In this manner, the outer tube 700 ensures that air does not enter the interior vacuum channel 112, such as through a leak.

The double-walled construction of the tube 102 provides wall redundancy that protects against a rapid loss of pressure, and increases the structural stability of the tube 102. Alternatively, the tube 102 may be formed as a single wall tube.

Figure 10:
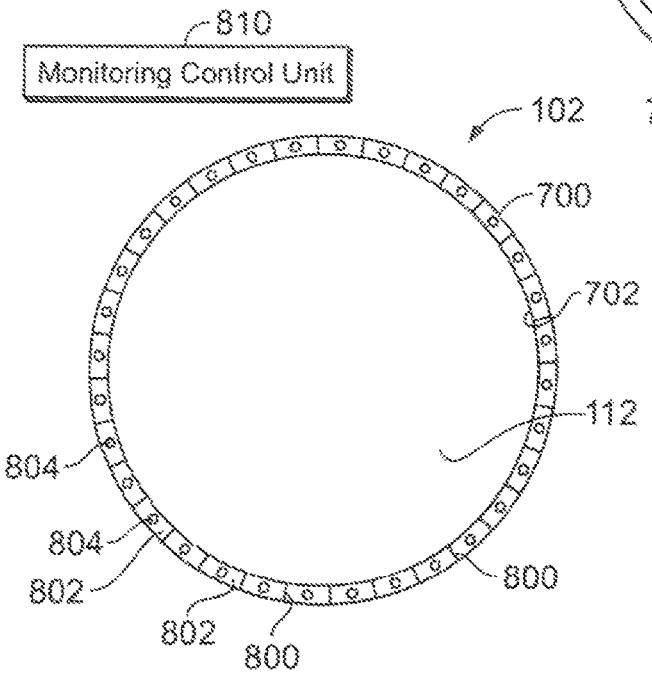
FIG. 10 illustrates an axial cross sectional view of a tube through line 9-9 of FIG. 2, according to an embodiment of the present disclosure.

FIG. 10 illustrates an axial cross sectional view of the tube 102 through line 9-9 of FIG. 2, according to an embodiment of the present disclosure. As shown in FIG. 10, a plurality of stabilizers, such as planar fins 800, may connect the outer tube 700 to the inner tube 702. The fins 800 may be flat plates, ridges, ribs, or the like extending between the outer tube 700 and the inner tube 702. The fins 800 provide stiffening structures that stably couple the outer tube 700 to the inner tube 702.

In at least one embodiment, the fins 800 define a plurality of sealed compartments or cavities 802 between the outer tube 700 and the inner tube 702. One or more sensors 804 may be secured within each compartment 802. The sensors 804 may be fluid sensors (such as air or water sensors), pressure sensors, temperature sensors, and/or the like that are configured to output signals that are received by a monitoring control unit 810 that monitors the sensors 804. By monitoring the output signals, the monitoring control unit 810 determines the integrity of the vacuum within the interior channel 112. For example, the monitoring control unit 810 may determine that the outer tube 700 and the inner tube 702 are contiguous and stable (and therefore a vacuum is maintained within the interior channel 112) when the signals received from the sensors 804 are at a predetermined level or within a predetermined acceptable range. If, however, one of the signals from the sensors 804 is below or above the predetermined level or range, the monitoring control unit 810 determines that the outer tube 700 and/or the inner tube 702 has been damaged proximate to the sensor 804 that outputs the out-of-range signal. In this manner, the monitoring control unit 810 is able to locate an area of the tube 102 that is to be repaired or replaced.

The tube 102 may include more or less sensors 804 than shown. For example, less than all of the compartments 802 may include a sensor 804.

Figure 11:
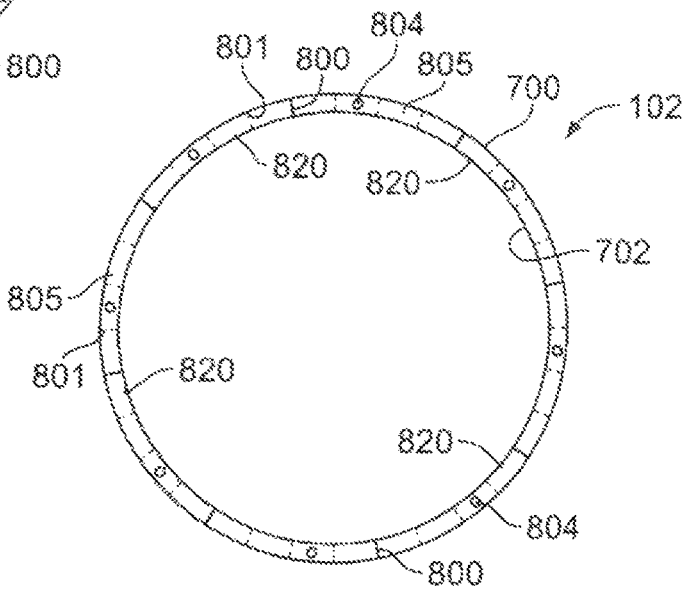
FIG. 11 illustrates an axial cross sectional view of a tube through line 9-9 of FIG. 2, according to an embodiment of the present disclosure.

FIG. 11 illustrates an axial cross sectional view of the tube 102 through line 9-9 of FIG. 2, according to an embodiment of the present disclosure. In this embodiment, solid fins 800 may extend between the outer tube 700 and the inner tube 702. Opened fins 801 (that is, fins having at least one opening formed therein) may be positioned between solid fins 800. The open fins 801 allow fluid communication through the openings. In this manner, extended compartments 805 may be defined between the solid fins 800. One or more sensors 804 may be positioned within each compartment 805. Optionally, the tube 102 may not include the opened fins 801.

Referring to FIGS. 9-11, in at least one embodiment, the connection between each fin 800 and the outer and inner tubes 700 and 702 is such that the compartments 802 (or 805) are fluid-tight. The space between the tubes 700 and 702 may be divided into a plurality of individual sections, each sealed with respect to the ambient atmosphere exterior to the outer tube 700, the vacuum interior to the inner tube 702, and each other. A sensor 804 that is capable of detecting fluid (such as air or water) is placed in each of the individual volumes (as shown in FIG. 10). As such, the sensor 804 is able to detect leaks in the outer tube 700 proximate to the compartment 804 or 805 in which the sensor 804 is located. As such, each sensor 804 is able to isolate a location of a detected leak.

Further, the compartments 802 or 805 may be used to set and/or maintain the vacuum in the interior channel 112 at a desired level. For example, if a section of the tube 102 is opened to ambient air (for example, routine maintenance or damage to the tube 102), the compartments 802 or 805 in the tube 102 may be used to quickly bring the interior channel 112 back to a desired degree of vacuum in a relatively short amount of time.

For example, the space 706 may be separated into four vacuum sections. The four different vacuum sections may have vacuums at, for example, $10^{-1}$ atm, $10^{-2}$ atm, $10^{-3}$ atm, and $10^{-4}$ atm. Optionally, the space 706 may be separated into more or less vacuum sections at different pressures than listed.

After the tube 102 has been serviced or repaired, for example, the interior channel 112 may be at ambient pressure. Each vacuum section may include a valve 820 (shown in FIG. 11) that fluidly couples the vacuum section to the interior channel 112. A valve 820 is opened to the vacuum section at which the pressure is at a first degree of vacuum (such as $10^{-1}$ atm). The air from the interior channel 112 moves into the vacuum section via the open valve until the pressure in the interior channel 112 is approximately $10^{-1}$ atm. The valve may then be closed. The process repeats with respect to each section in order to achieve different degrees of vacuum within the interior channel 112.

In at least one embodiment, the inner and outer tube thicknesses may be the same. Each tube 700 and 702 may be formed of a metal, such as steel. However, the thicknesses of the inner and outer tubes 700 and 702 may be different, and each may be formed of a different material. For example, the outer tube 700 may be reinforced concrete, while the inner tube 702 may be formed of metal.

The interior stiffeners (such as the fins 800) may also be of a different material compared to either the inner and outer tubes 700 and 702. The stiffeners may be formed from a material that has a low thermal conductivity, so that the inner and outer tubes 700 and 702 are thermally isolated, thereby allowing a temperature of the interior tube 702 to be more easily controlled.

The double-walled construction of the tube 102 provides a safe and effective transportation system in that the outer tube 700 protects the inner tube 702 from damage, and maintains the integrity of the vacuum within the interior channel 112. The stiffeners (such as the fins 800) couple the tubes 700 and 702 together while reducing an overall weight of the tube 102 (as compared to a single wall having an increased thickness).

Figure 13:
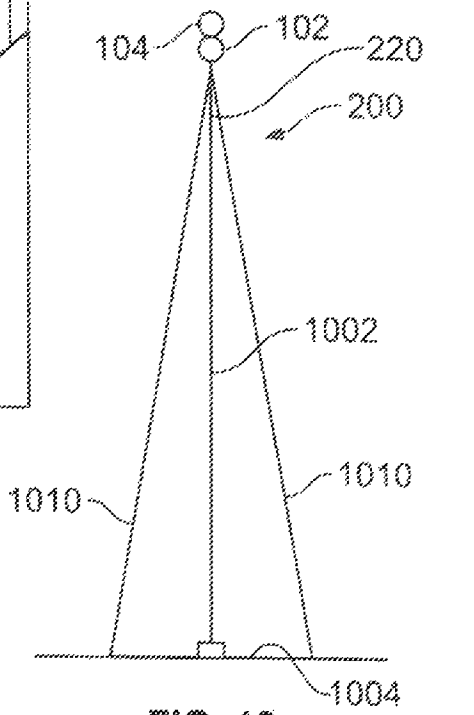
FIG. 13 illustrates an end view of a transportation system, according to an embodiment of the present disclosure.
Figure 12:
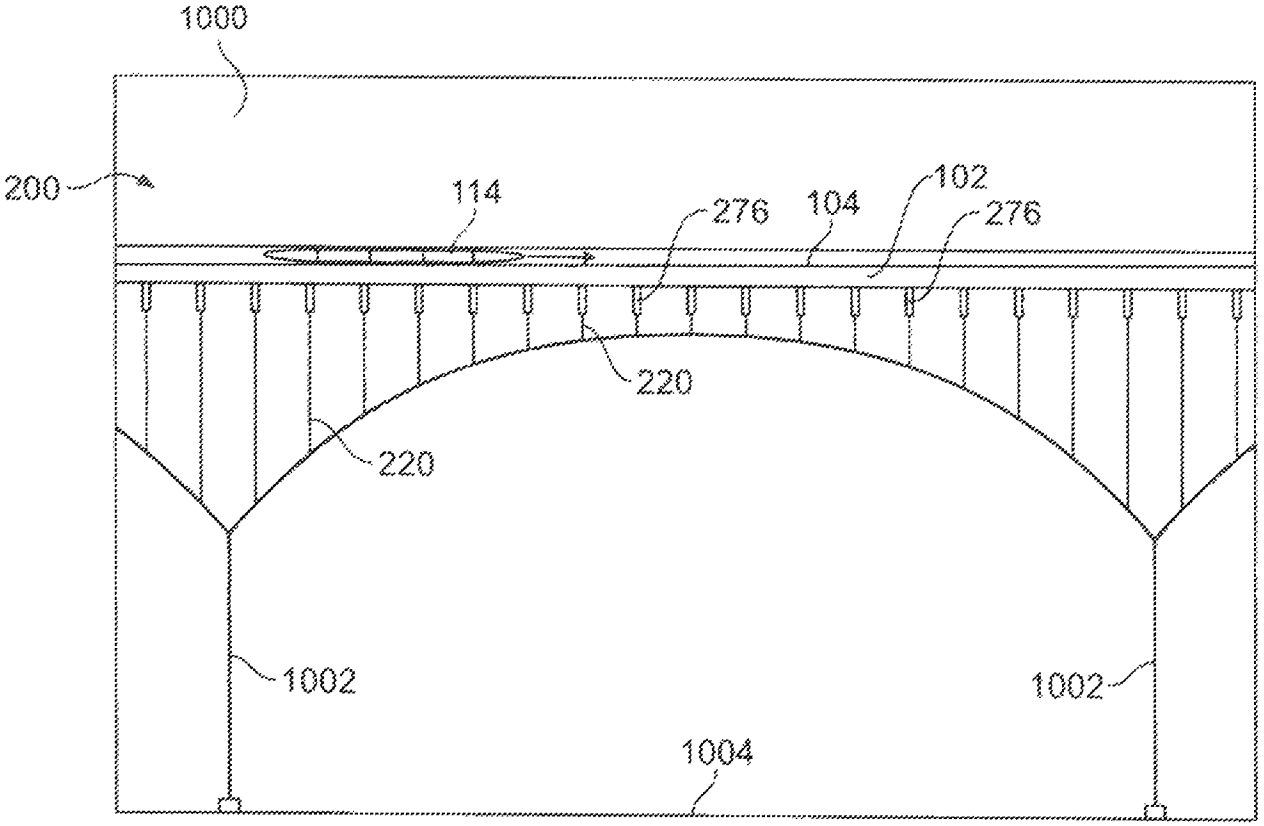
FIG. 12 illustrates a lateral view of a transportation system, according to an embodiment of the present disclosure.

FIG. 12 illustrates a lateral view of a transportation system 200, according to an embodiment of the present disclosure. FIG. 13 illustrates an end view of the transportation system 200. Referring to FIGS. 12 and 13, the transportation system 200 may be under water 1000. Instead of gravity causing the tension in the tension support members 220, the tension is caused by an upward force caused by the buoyancy of the tubes 102 and 104 in the water 1000. Instead of supports that carry compression, the transportation system 200 may include tension lines 1002 that extend to the sea floor 1004. As the vehicle 114 travels along the tube 104 resulting in a downward force, the actuators 226 lengthen (instead of shorten), thereby allowing the tubes 102 and 104 to float up enough to balance the downward deflection caused by the weight of the vehicle 114.

At certain intervals along the route, slanted, diagonal cables 1010 prevent the tubes 102 and 104 from drifting due to ocean currents. The cables 1010 may be paired, such as one on each side of the tubes 102 and 104, and may be at similar angles with respect to the tubes 102 and 104. The cables 1010 (*s*) may be attached to the tube(s) 102 or 104 near the major vertical cables, or they may be attached in other locations along the tube(s) 102 or 104.

As described above with respect to FIGS. 1-13, embodiments of the present disclosure provide systems and methods for supporting one or more tubes of a transportation system. The systems and methods reduce deflections as a vehicle travels through the tube in an efficient and cost-effective manner.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A transportation system, comprising:

a tension support member having a first end coupled to a suspension cable and a second end coupled to a first tube through an actuator, wherein the tension support member exerts tension force to urge the first tube towards the suspension cable; and a tension control unit including one or more processors in communication with the actuator, wherein the tension control unit is configured to control operation of the actuator to adjust the tension force in response to detection of a vehicle traveling through a first interior channel of the first tube to reduce deflection of the first tube.

2. The transportation system of claim 1, wherein the suspension cable extends between a first support tower and a second support tower, and wherein the first interior channel extends between the first support tower and the second support tower.

3. The transportation system of claim 1, wherein the actuator is configured to contract to adjust the tension force.

4. The transportation system of claim 1, wherein the actuator is configured to adjust a length of the tension support member to adjust the tension force.

5. The transportation system of claim 1, wherein the actuator comprises:

a bearing; and an actuating member moveably secured to the bearing, wherein the actuating member is configured to move with respect to the bearing in order to adjust the tension force.

6. The transportation system of claim 5, wherein the bearing is directly coupled to one of the suspension cable or the first tube, and wherein the actuating member is directly coupled to the other of the suspension cable or the first tube.

7. The transportation system of claim 1, further comprising a plurality of sensors coupled to the first tube, wherein the plurality of sensors are configured to detect a location of the vehicle within the first interior channel, and wherein the tension control unit is in communication with the plurality of sensors.

8. The transportation system of claim 1, wherein the first tube is stacked over a second tube.

9. The transportation system of claim 1, wherein the first tube is arranged to a side of a second tube.

10. The transportation system of claim 1, wherein a vacuum is formed in the first interior channel, wherein the vacuum reduces aerodynamic drag on the vehicle as the vehicle travels through the first interior channel.

11. The transportation system of claim 1, wherein the vehicle is a magnetic levitation vehicle.

12. The transportation system of claim 1, wherein the first tube comprises an outer tube surrounding an inner tube.

13. The transportation system of claim 12, wherein the outer tube is separated from the inner tube by a space.

14. The transportation system of claim 13, wherein the first tube further comprises a plurality of stiffeners within the space between the outer tube and the inner tube, wherein the plurality of stiffeners define a plurality of sealed compartments.

15. The transportation system of claim 14, wherein the first tube further comprises at least one fluid sensor within at least one of the plurality of sealed compartments.

16. The transportation system of claim 13, wherein the space is divided into a plurality of vacuum sections, wherein each of the plurality of vacuum sections includes a different degree of vacuum, and wherein the different degrees of vacuum within the plurality of vacuum sections are configured to set a vacuum within the interior channel to a desired level.

17. A method of supporting a transportation system, the method comprising:

exerting tension force with a tension support member to pull a tube towards a suspension cable;

detecting a vehicle traveling through an interior channel of the tube; and controlling an actuator to adjust the tension force in response to said detecting the vehicle traveling through the interior channel of the tube to reduce deflection of the tube.

18. The method of claim 17, wherein the controlling comprises contracting the actuator to adjust the tension force.

19. The method of claim 17, wherein the controlling comprises using the actuator to adjust a length of the tension support member.

20. The method of claim 17, further comprising:

communicatively coupling a tension control unit including one or more processors with the actuator; and using the tension control unit to control operation of the actuator.

21. The method of claim 17, further comprising forming the tube with an outer tube surrounding an inner tube.

22. The method of claim 21, further comprising providing a plurality of stiffeners within a space between the outer tube and the inner tube, wherein the plurality of stiffeners define a plurality of sealed compartments.

23. The method of claim 22, further comprising disposing at least one fluid sensor within at least one of the plurality of sealed compartments.

24. The method of claim 22, further comprising:

dividing the space into a plurality of vacuum sections;

varying a degree of vacuum within each of plurality of vacuum sections;

using the varying degrees of vacuum within the plurality of vacuum sections to set a vacuum within the interior channel to a desired level.

25. A transportation system, comprising:

a tension support member having a first end coupled to a suspension cable and a second end coupled to a first tube through an actuator, wherein the first tube comprises:

an outer tube surrounding an inner tube;

a plurality of stiffeners within a space between the outer tube and the inner tube, wherein the plurality of stiffeners define a plurality of sealed compartments; and at least one fluid sensor within at least one of the plurality of sealed compartments, wherein the tension support member exerts tension force to urge the first tube towards the suspension cable, and wherein the actuator is configured to be controlled to adjust the tension force upon detecting a vehicle traveling through a first interior channel of the first tube to reduce deflection of the first tube.

26. A transportation system, comprising:

a tension support member having a first end coupled to a suspension cable and a second end coupled to a first tube through an actuator, wherein the first tube comprises an outer tube surrounding an inner tube, wherein the outer tube is separated from the inner tube by a space, wherein the space is divided into a plurality of vacuum sections, wherein each of the plurality of vacuum sections includes a different degree of vacuum, and wherein the different degrees of vacuum within the plurality of vacuum sections are configured to set a vacuum within the interior channel to a desired level, wherein the tension support member exerts tension force to urge the first tube towards the suspension cable, and wherein the actuator is configured to be controlled to adjust the tension force upon detecting a vehicle traveling through a first interior channel of the first tube to reduce deflection of the first tube.

* * * * *